US006294306B1

(12) United States Patent
Kmiecik-Lawrynowicz et al.

(10) Patent No.: US 6,294,306 B1
(45) Date of Patent: Sep. 25, 2001

(54) METHOD OF MAKING TONERS

(75) Inventors: Grazyna E. Kmiecik-Lawrynowicz, Fairport; Chieh-Min Cheng, Rochester, both of NY (US); Bernard Grushkin, Bedford, MA (US); Karen L. LaMora, Marion; Casimir Mytych, Rochester, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/510,377

(22) Filed: Feb. 22, 2000

(51) Int. Cl.[7] ..... G03G 9/087
(52) U.S. Cl. ..... 430/137.14; 430/109.4
(58) Field of Search ..... 430/106, 137, 430/137.14, 109.4

(56) References Cited

U.S. PATENT DOCUMENTS

| | | | |
|---|---|---|---|
| 5,013,630 | 5/1991 | Ong et al. | 430/138 |
| 5,023,159 | 6/1991 | Ong et al. | 430/109 |
| 5,045,422 | 9/1991 | Kmiecik-Lawrynowicz et al. | 430/109 |
| 5,080,986 | 1/1992 | Kmiecik-Lawrynowicz et al. | 430/39 |
| 5,114,819 | 5/1992 | Ong et al. | 430/106.6 |
| 5,145,762 | 9/1992 | Grushkin | 430/137 |
| 5,153,089 | 10/1992 | Ong et al. | 430/110 |
| 5,223,370 | 6/1993 | Sacripante et al. | 430/138 |
| 5,278,020 | 1/1994 | Grushkin et al. | 430/137 |
| 5,302,486 | 4/1994 | Patel et al. | 430/137 |
| 5,334,471 | 8/1994 | Sacripante et al. | 430/106.6 |
| 5,346,790 | 9/1994 | Sacripante et al. | 430/106 |
| 5,368,970 | 11/1994 | Grushkin | 430/110 |
| 5,486,444 | 1/1996 | Bayley et al. | 430/109 |
| 5,496,676 | 3/1996 | Croucher et al. | 430/137 |
| 5,520,993 | 5/1996 | Lambert | 428/215 |
| 5,525,452 * | 6/1996 | Hopper et al. | 430/137 |
| 5,573,825 | 11/1996 | Brewster | 428/43 |
| 5,582,951 | 12/1996 | Patel et al. | 430/137 |
| 5,647,107 | 7/1997 | Brewster | 24/713.6 |
| 5,698,296 | 12/1997 | Dotson et al. | 428/195 |
| 5,766,817 | 6/1998 | Cheng et al. | 430/137 |
| 5,847,030 | 12/1998 | Mahabadi et al. | 524/32 |
| 5,853,943 | 12/1998 | Cheng et al. | 430/137 |
| 5,866,290 | 2/1999 | Sacripante et al. | 430/109 |
| 5,888,622 | 3/1999 | Pinell et al. | 428/195 |

* cited by examiner

*Primary Examiner*—John Goodrow
(74) *Attorney, Agent, or Firm*—Oliff & Berridge, PLC

(57) ABSTRACT

Toners are described which include one or more copolymers combined with colorant particles or primary toner particles. Processes for preparing the toners are also disclosed.

20 Claims, No Drawings

METHOD OF MAKING TONERS

BACKGROUND OF THE INVENTION

1. Field of the Invention

Embodiments of the present invention relate in general to toner and developer compositions, and more specifically, to the use of one or more copolymers in the toner preparation process. According to a first aspect, one or more copolymers are combined with colorant particles which are then combined with primary toner particles to form composite toner particles which are referred to generally herein as toners. According to a second aspect, one or more copolymers are combined with primary toner particles. The combination is then combined with colorant particles to form toners. According to a third aspect, one or more copolymers are used as seed particles during preparation of a primary toner particle. According to one embodiment, the one or more copolymers are encapsulated within a primary toner particle and optionally can be uniformly distributed throughout a primary toner particle which is then used to form toners.

The resulting toners can be selected for known electrophotographic imaging and printing processes, including color processes, digital imaging, combined facsimile, copier, and printer applications and lithography.

2. Description of Related Art

Known reprographic technologies, such as xerographic and ionographic technologies and devices utilize toners having small average volume diameter particle sizes which can generally range from about 2 microns to about 20 microns. In certain xerographic applications, such as high volume copier-duplicator applications, high resolution characteristics and low image noise are highly desired. These characteristics can be readily attained utilizing small sized toners with volume average diameters of less than 11 microns, preferably between about 2 and about 7 microns, and with narrow geometric size distribution (GSD) of less than about 1.6 or preferably less than about 1.4. Additionally, in some xerographic systems wherein process color is required such as pictorial color applications, small particle size colored toners of about 2 to about 10 microns volume average diameter are highly desired to avoid paper curling which results when moisture is driven out of the paper due to high fusing temperatures of from about 120° C. to about 200° C. Paper curling can be particularly pronounced in xerographic color processes primarily because of the presence of relatively high toner coverage as a result of the application of three to four color toners. The size and amount of the toner particle in part dictates the amount of heat required to fuse the toner to the paper. Lower particle sizes require less heat and therefore produce less paper curling during the fusing process. The amount of toner layers present on the paper to be fused also effects paper curling since a thicker toner plastic level present after the fusing step inhibits the paper from sufficiently absorbing the moisture lost during the fusing step, and image paper curling results. These and other imaging shortfalls and problems are avoided or minimized with the toners and processes of the present invention.

Certain toner particle sizes can be selected, such as from about 2 to about 10 microns volume average diameter, and with a high colorant loading such as from about 3% to about 65% by weight of toner, or from about 3% to about 25% by weight of toner, so that the mass of toner necessary for attaining the required optical density and color gamut can be significantly reduced to eliminate or minimize paper curl. Lower toner mass also promotes image uniformity.

However, higher pigment loading often adversely affects the charging behavior of toners. For example, the charge levels may be too low for proper toner development or the charge distributions may be too wide and toners of wrong charge polarity may be present. Furthermore higher colorant loadings may also result in sensitivity of charging behavior to changes in environmental conditions such as temperature and humidity. Toners prepared in accordance with the processes of the present invention minimize, or avoid these disadvantages.

Numerous processes are known for the preparation of toners, such as, for example, conventional processes wherein a resin is melt kneaded or extruded with a pigment, micronized and pulverized to provide toner particles with a volume average diameter of from about 7 microns to about 20 microns and with broad geometric size distributions. In such processes it is usually necessary to subject the aforementioned toners to a classification procedure such that the geometric size distribution of from about 1.2 to about 1.6 or from about 1.2 to about 1.4 are attained. However, in the aforementioned conventional process, low toner yields after classifications may be obtained.

Additionally, other processes such as and including encapsulation, coagulation, coalescence, suspension polymerization, or semi-suspension and the like, are known, wherein the toners are obtained by in situ one pot methods. Moreover, encapsulated toners are known wherein a core comprised of pigment and resin is encapsulated by a shell, and wherein the toner melt Theological properties are separated wherein a core material provides low fusing properties such as from about 100° C. to about 125° C., and an encapsulating shell provides necessary blocking properties for particle stability prior to fusing. Other in situ toners prepared by suspension, coagulation, coalescence, are known, wherein the toners are comprised of substantially similar composition to conventional toners with, in some cases, having surfactants or surface additives on the toner surface prepared by various processes.

U.S. Pat. No. 4,996,127 illustrates a toner of associated particles including primary particles of a polymer having acidic or basic polar groups and secondary particles of a coloring agent. The polymers selected for the toners of the '127 patent can be prepared by an emulsion polymerization method; see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. U.S. Pat. No. 4,983,488 discloses a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. This process results in, it is believed, the formulation of particles with a wide particle size distribution. Hence, classification, is required, resulting in low toner yields. U.S. Pat. No. 4,797,339 discloses a process for the preparation of toners by resin emulsion polymerization, wherein certain polar resins are selected. U.S. Pat. No. 4,558,108 discloses a copolymer of styrene and butadiene produced by specific suspension polymerization. Other prior art includes U.S. Pat. Nos. 3,674,736, 4,137,188 and 5,066,560.

Emulsion/aggregation/coalescence processes for the preparation of toners are illustrated in a number of patents, the disclosures of each of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797. U.S. Pat. No. 5,853,943 discloses the preparation of a seed particle latex by aqueous emulsion polymerization of a portion of an initial monomer emulsion. The remainder of the initial monomer emulsion is then added to the seed particle latex. Also of interest may be U.S. Pat. Nos. 5,348,832, 5,405,728, 5,366,841, 5,496,676, 5,527,658, 5,585,215, 5,650,255, 5,650,266, 5,368,970, 5,486,444, 5,866,290, 5,582,951, 5,302,486, 5,223,370, 5,153,089, 5,114,819, 5,080,986, 5,045,422, 5,023,159, 5,013,630, 5,334,471, 5,346,790, 5,145,762, 5,766,817 and 5,501,935 each of which are incorporated herein by reference in their entireties. Additional patents which may be of further interest include U.S. Pat. Nos. 5,520,993, 5,573,825, 5,647,107, 5,698,296 and 5,888,622.

Accordingly, there is a need to develop processes for the manufacture of toners having small average particle sizes of from about 1 micron to about 25 microns, from about 2 microns to about 12 microns, from about 3 microns to about 9 microns and preferably from about 5 to about 7 microns without resorting to classification processes, and wherein high toner yields are attained such as from about 90 percent to about 99.7 percent or higher or from about 92 to about 96 percent, and ranges in between, in certain embodiments.

There is a further need to develop processes for the manufacture of toners where colorants are uniformly dispersed throughout a toner particle or portions of a toner particle. There is a still further need to develop processes for the manufacture of toners having improved charging and fusing (crease) properties, projection efficiency and toner color properties. Lower fusing temperatures reduce the energy requirements of the fuser and more importantly result in lower moisture driven off from the paper during fusing, and hence lower or minimize paper curling. There is an even still further need to develop toners having improved mechanical properties by the inclusion of components such as copolymers which reinforce the structure of the toners.

There is an even still further need to develop toners having useful glass transition temperatures, and that are suitably resistant to caking, blocking or undesired aggregation of toner particles, and further having suitably low fixing temperatures as well as useful triboelectric, gloss and humidity characteristics.

There is a need for black or colored toners wherein small particle sizes of less than or equal to 25 microns in volume diameter, and preferably between about 1 micron and about 25 microns, between about 2 microns and about 20 microns, between about 3 microns and about 9 microns, or between about 5 microns to about 7 microns in volume diameter.

SUMMARY OF THE INVENTION

It is a feature of the present invention to provide toners with many of the advantages illustrated herein. It is another feature of the present invention to provide simple and economical processes for the preparation of latexes, and black and colored toner compositions with advantageously useful colorant dispersions. It is still another feature of the present invention to provide emulsion aggregation processes for the preparation of toners which include encapsulated copolymers or other additive particles and wherein micronizing, jetting, and classification can in certain embodiments be avoided.

It is a still further feature of the present invention to provide toners that include one or more copolymers and have advantageous colorant passivation. It is an even further feature of the present invention to provide toners including a colorant particle that includes one or more copolymers. It is a yet still further feature of the present invention to provide toners having advantageous colorant dispersion within and on the toner.

It is an additional feature of the present invention to provide toners having one or more copolymers encapsulated and optionally uniformly dispersed therein and exhibiting improved charging and fusing properties and mechanical properties. In yet another feature of the present invention there are provided toners with advantageous fusing temperature, gloss characteristics, projection efficiencies, paper curl and blocking characteristics.

These and other objects, features and advantages of the present invention will become apparent by reference to the remaining portions of the specification and the claims.

Embodiments of the present invention are directed to toners and methods for the preparation of toners. According to certain embodiments of the present invention, one or more copolymers particles are advantageously encapsulated within toners or are otherwise incorporated into toners or colorants and result in improved fusing properties. According to one embodiment, the copolymers form discrete regions or domains within primary toner particles and are not homogenous with the polymer resin constituting, whether in whole or in part, the primary toner particles. Without wishing to be bound by any scientific theory, it is believed that the copolymer particles of the present invention have an advantageous affinity for colorants and therefore colorants are attracted to and concentrate on and/or near the copolymer domains. The copolymer particles advantageously serve to promote colorant passivation and reduce the effect of colorants on the triboelectric properties of the toner by encapsulating the colorants or by drawing the colorants within the interior of the toner particle and away from the surface of the toner particle. The further colorant is away from the surface of the toner, the less effect it will have on triboelectric properties. The triboelectric properties will instead be determined more by the polymer resin forming the primary toner particle. In this manner, the use of copolymers in accordance with the present invention that form discrete regions within or on a primary toner particle or colorant particle or otherwise encapsulate a primary toner particle or colorant particle serves lo advantageously reduce the charging effects of colorants in toners and improve fusing characteristics.

It is also believed that the copolymer particles of the present invention increase structural integrity of toners thereby promoting advantageous toner characteristics. For example, the addition of the copolymer particles serves to reinforce the resin polymer of the primary toner particle, to increase the elastic properties of the resin thereby reducing its brittleness and to improve fusing characteristics.

According to one embodiment, one or more copolymer particles are incorporated into or alternatively onto a primary toner particle which may or may not include a colorant. Additionally, the one or more copolymer particles can be encapsulated within or uniformly distributed throughout the primary toner particles forming discrete regions therein rather than simply being combined or fused with the primary toner particles. According to this aspect of the present invention, the one or more copolymer particles primarily function as seed particles during a polymerization to produce a polymerized particle, i.e. primary toner particle, having the copolymer seed particles dispersed therein. According to one embodiment of the present invention, the one or more copolymer particles may be characterized as having plasticizing or film-forming properties and may in certain embodiments be the same or different from the polymer or copolymer forming the primary toner particle.

Toners prepared according to certain methods of the present invention exhibit an improved and uniform dispersion of the one or more copolymer particles throughout the primary toner particle, although primary toner particles having a nonuniform dispersion of copolymer particles are also useful in the practice of the present invention. The uniform dispersion of the one or more copolymer particles promotes improved passivation and uniform dispersion of pigment particles. Toners of the present invention also exhibit improved and advantageous charging and fusing properties and paper adhesion properties compared to toners without the copolymers. In addition, the toners of the present invention incorporating the one or more copolymer particles exhibit improved and advantageous mechanical properties as a result of the copolymer particles acting to structurally reinforce the toner.

According to a certain embodiment of the present invention, a process is provided for preparing a toner including at least one primary toner particle and at least one colorant. The toner may also contain additional additive particles capable of producing a desired effect. The primary toner particle includes a polymer or copolymer resin to which is combined or within which is dispersed or encapsulated one or more discrete copolymer particles or copolymer domains. The copolymer particles may be the same or different. The copolymer particles include a styrene/acrylic copolymer such as styrene/ethyl hexyl acrylate copolymer. The copolymer particles can be in the form of an ultra-low particle size emulsion, including for example water, n-propyl alcohol and the like, and wherein the copolymer particle size ranges from about 0.05 microns to about 1.2 microns or about 0.1 to about 1.0 microns volume average diameter. The molecular weight of the copolymer particles can be in the form of a distribution and can be within the range of about 87,000 to about 174,000.

According to one embodiment of the present invention, the colorant residis substantially on the surface of the primary toner particle and can alternatively include the one or more copolymer particles combined thereto. Alternatively, the toners of the present invention can include a primary toner particle which does not include the one or more copolymer particles and a colorant which does include the one or more copolymer particles. Embodiments of the present invention, therefore, provide toners where either one or both of the primary toner particle and the colorant can include one or more copolymer particles. The toners of the present invention, whether including a colorant or not, have an average volume diameter of less than or equal to 25 microns in volume diameter, and preferably between about 1 micron and about 25 microns, between about 2 microns and about 10 microns, between about 3 microns and about 9 microns, or between about 5 microns to about 7 microns volume average diameter.

One method for making the toners in accordance with embodiments of the present invention includes preparing a latex emulsion by agitating a mixture of monomers including olefins such as styrene and butadiene in an aqueous medium optionally containing one or more of nonionic or anionic surfactants, a chain transfer agent or a free radical initiator. The latex emulsion may or may not contain the one or more copolymer particles, depending upon whether inclusion of the one or more copolymer particles with the primary toner particle is desired. The one or more copolymer particles can be directly added to the monomer latex emulsion in the form of a dispersion of one or more copolymer particles to act as seeds during the polymerization of the primary toner particle. The one or more copolymer particle have a volume average diameter of between about 0.05 microns to about 1.2 microns and about 0.1 microns to about 1.0 microns volume average diameter. Copolymer particles useful in the present invention include particles for example formed from styrene/acrylate copolymers. Alternatively, copolymer particles can be dispersed in a suitable fluid such as water and then added to the monomer latex emulsion to avoid premature coagulation of the latex and the copolymer particles.

The monomer mixture is polymerized by heating to form primary toner particles in water. If the latex emulsion includes the copolymer particles as seed particles, then the resulting polymerized primary toner particles will include the copolymer particles encapsulated therein and forming discrete domains, and preferably uniformly distributed throughout the primary toner particle. As an alternate step, preformed primary toner particles can be mixed with an emulsion of the copolymer particles, and the resulting mixture aggregated to produce primary toner particles having copolymer particles bound thereto or otherwise encapsulating the primary toner particle in whole or in part.

Thereafter, colorants such as pigments or dyes are added and dispersed with the primary toner particles and the mixture is flocculated for example by the addition of a flocculant or surfactant. The colorants may or may not include the copolymer particles bound thereto. The flocculated mixture is then homogenized to form statically bound primary toner particle and colorant particle aggregates of from equal to or less than about 25 microns volume average diameter and preferably less than about 10 microns volume average diameter. The aggregate mixture is then heated so as to fuse the colorant and primary toner particle together to form toners having a volume average diameter of from about 1 to about 25 micron, between about 2 microns and about 10 microns, between about 3 microns and about 9 microns, or between about 5 microns to about 7 microns volume average diameter, including all subranges and individual values within the above ranges. Additional particles imparting desirable toner characteristics well known to those skilled in the art can also be fused or otherwise included to the toner as desired.

The toners may additionally have chemically modified outer surfaces. For example, the surface of the toners optionally can be chemically modified with chlorine gas to transform olefinic resin present on the outer surface of the toner to, for example, a chlorinated species. The toner can then be isolated, concentrated, washed, dried and collected. The toner and developer compositions of the present invention can be selected for electrophotographic, especially xerographic imaging and printing processes, including color processes.

DETAILED DESCRIPTION OF CERTAIN PREFERRED EMBODIMENTS

The principles of the present invention may be advantageously applied to produce novel methods of making toners that include one or more discrete copolymer particles either bound to or encapsulate therein. According to one embodiment of the present invention, a toner is prepared which includes a colorant particle, such as a pigment or dye, having one or more copolymer particles bound thereto or otherwise encapsulating the colorant in whole or in part. An alternate embodiment of the present invention includes a toner having a preformed primary toner particle with one or more copolymer particles bound thereto or otherwise encapsulating the primary toner particle in whole or in part. Alternatively, the primary toner particle includes one or more copolymer particles encapsulated therein or otherwise dispersed within the primary toner particle to form discrete regions of the copolymer. The discrete regions of the copolymer may be either uniformly or nonuniformly dispersed within the primary toner particle. The primary toner particle can then be fused with a colorant and/or other particle to produce desirable properties for a toner such as a reduced effect of the pigment on toner properties, and advantageous charging and fusing properties. Optional charge enhancing additives comprised of, for example, chromium salicylates, quaternary ammonium hydrogen bisulfates, tetraalkyl ammonium sulfonate, and the like and mixtures thereof can be employed, as well as, other additives useful in making toners. Other additives include wax components, compatibilizers, magnetic components, carrier particles, binder resins, flow additives, emulsifiers, pigment dispersant and the like.

According to one embodiment of the present invention, a dispersion of one or more copolymer particles is provided. The dispersion includes copolymer particles with for example an average volume diameter of from about 0.05 microns to about 1.2 microns or 0.1 microns to about 1.0 microns specifically including all subranges and individual values within the range of about 0.05 microns to about 1.2 microns. Suitable copolymer particles useful in the present invention include those formed from copolymers of styrene functional monomer and alkyl acrylates, copolymers of styrene functional monomer and alkyl methacrylates, copolymers of aromatic (meth)acrylate and alkyl (meth) acrylate and the like or a mixture thereof. Examples of useful styrene functional monomers include styrene, methylstyrene, 4-methylstyrene, 3-chlorostyrene, 2,5-dichlorostyrene, 4-bromostyrene, 4-tert-butylstyrene, 4-methoxystyrene and the like or a mixture thereof Examples of useful alkyl acrylates include acrylic ester having an alkyl group of from about four to about twelve carbon atoms, such as butyl acrylate, hexyl acrylate, heptyl acrylate, 2-ethylhexyl acrylate, octyl acrylate, decyl acrylate, lauryl acrylate, and the like or a mixture thereof. Examples of useful alkyl methacrylates include methacrylic ester having an alkyl group of from about six to about eighteen carbon atoms, such as hexyl methacrylate, heptyl methacrylate, 2-ethylhexyl methacrylate, octyl methacrylate, decyl methacrylate, lauryl methacrylate, stearyl methacrylate, and the like or a mixture thereof Examples of useful aromatic (meth)acrylates include benzyl acrylate, phenyl acrylate, phenethyl acrylate, benzyl methacrylate, phenyl methacrylate, and the like or a mixture thereof. It is to be understood that other suitable copolymers will readily be identified by one skilled in the art based on the present disclosure.

According to a preferred embodiment of the present invention, the copolymer includes a copolymer of styrene and 2-ethylhexyl acrylate, such as is commercially available in the form of a resin emulsion in the LUCIDENE line of products from Morton International, Inc., such as LUCIDENE 126 or LUCIDENE 246. According to the present invention, the copolymers are present as a distribution having an average molecular weight of between about 87,000 and about 174,000, and more preferably about 136,000, specifically including all subranges and individual values within the range of about 87,000 to about 174,000, an $M_n$ of 4,700, and a molecular weight distribution of 29.0 as determined on a Waters GPC, and a mid-point Tg of −11.8° C., as measured on a Seiko DSC. The LUCIDENE resin emulsion contains about 47% solids to about 53% solids with the latex resin having a volume average diameter of about 107 nanometers as measured by light scattering technique on a Coulter N4 Plus Particle Sizer.

The copolymer particles of the present invention may advantageously possess plasticizing or film-forming properties. The copolymer particles of the present invention have been found to have a strong affinity to colorant dispersions, such as pigments or dyes, in that, for example passivation of colorants can be advantageously accomplished through inclusion of the copolymer particles in toners having colorants due to the copolymers surrounding the colorants or otherwise drawing the colorants away from the surface of the toners.

According to one aspect of the present invention, an emulsion is prepared by agitating in water a mixture of one or more of an optional nonionic surfactant such as polyethylene glycol or polyoxyethylene glycol nonyl phenyl ether, an optional anionic surfactant such as sodium dodecyl sulfonate or sodium dodecyl benzenesulfonate, a first monomer such as styrene, acrylate or methacrylate, an optional second monomer such as butadiene or isoprene and optionally the one or more copolymer particles which are used as a seeding agent during polymerization to form polymerized particles. Where the copolymer particles are included, polymerization of the monomer(s) then takes place in a manner to encapsulate or otherwise incorporate the copolymer particles by heating from ambient temperature to about 80° C. Emulsion sized resin particles incorporating the copolymer particles are produced having a volume average diameter of from about 0.05 microns to about 1.2 microns specifically including all subranges and individual values within the range of about 0.05 microns to about 1.2 microns. Alternatively, the copolymer particles are excluded from the monomer latex emulsion should the production of emulsion sized resin particles which do not include the copolymer particles be desired. Polymerization is then accomplished as describe above. The resulting resin emulsion which contains from about 20% to about 60% solids is then diluted with water to about 15% solids. One or more colorants, such as pigments or dyes, is then added to the resin emulsion in an amount less than or equal to about 65% by weight of the particle solids and preferably from about 3% to about 65% by weight of particle solids. The colorants may be pretreated so as to bind copolymer particles of the present invention thereto. Alternatively, the colorants may be encapsulated by the copolymer particles in whole or in part. The resulting mixture may optionally be dispersed utilizing a Brinkman or IKA homogenizer. A cationic surfactant such as dialkylbenzene dialkylammonium chloride and the like is next added to effect flocculation of the colorants with emulsion resin particles. The flocculated resin-colorant mixture is then homogenized at from about 2000 to about 6000 revolution per minute to form high shear statically bound aggregate composite particles. The statically bound aggregate composite particles are then heated at a temperature of from about 60° C. to about 95° C. and for a duration of about 60 minutes to about 600 minutes to form toners for example having a volume average diameter of from about 1 micron to about 25 microns, between about 2 microns and about 10 microns, between about 3 microns and about 9 microns, or between about 5 microns and about 7 microns volume average diameter. The toners may optionally be halogenated with a halogen, for example, chlorine gas to chemically transform nonpolar olefinic moieties of the resin present on the outer surface of the toner resin to chlorine containing hydrocarbon moieties. The toners may then be washed, filtered and dried. Flow additives to improve flow characteristics may then optionally be employed such as aerosils or silicas, and the like, of from about 0.1 to about 10 percent by weight of the toner.

Examples of useful monomers which may be included in the monomer latex emulsion prior to polymerization to form latex resin particles include functional monomers such as those described in U.S. Pat. No. 5,853,943 hereby incorporated by reference in its entirety and also olefins including, acrylates, acrylic acids, methacrylates, methacrylic acids, acrylonitrile, styrene and its derivatives such as methyl acrylate, ethylacrylate, prolyl acrylate, butyl acrylate, hexyl acrylate, methyl methacrylate, ethyl methacrylate, propyl methacrylate, butyl methacrylate, hexyl methacrylate, methyl styrene, and the like. Specific examples of nonionic monomers include styrene, alkyl substituted styrenes, halogenated styrenes, halogenated alkyl substituted styrenes and the like. It is to be understood that other useful monomers will become readily apparent to one of skill in the art based on the present disclosure.

Examples of additional useful monomers include nonionic diolefinic or diene monomers such as butadiene, substituted butadienes, for example, methyl butadiene, isoprene, mycerine, alkyl substituted isoprene, mixtures thereof and the like. It is to be understood that other useful monomers will become readily apparent to one of skill in the art based on the present disclosure.

Examples of emulsion resin particles used to form primary toner particles useful in the present invention include poly(styrene-alkyl acrylate), poly(styrene-1,3-diene), poly (styrene-alkyl methacrylate), poly(styrene-alkyl acrylate-acrylc acid), poly(styrene-1,3diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid, poly(styrenebutadieni), poly (methylstyrene-butadiene), poly(methylmethacrylate-butadiene), poly(ethyl methacrylate-butadiene), poly(propyl methacrylate-butadiene), poly(butylmethacrylate-butadiene), poly(methyl acrylate-butadiene), poly(etliyl acrylate-butadiene), poly(propyl acrylate-butadiene), poly (butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methylacrylate-isoprene), poly(ethyl acrylate-isoprene), poly(propyl acrylate-isoprene), and poly(butyl acrylate-isoprene); poly(styrene-propyl acrylate), poly (styrene-butyl acrylate), poly(styrene-butadiene-acrylic acid), poly(styrene-butadiene-methacrylic acid), poly (styrene-butadiene-acrylonitrile-acrylic acid), poly(styrene-butylacrylate-acrylic acid), poly(styrene-butyl acrylate-methacrylic acid), poly(styrene-butyl acrylate-acrylononitrile), and poly(styrene-butyl acrylate-acrylononitrile-acrylic acid) and the like.

Illustrative examples of specific latex resin, polymer or polymers selected for the process of the present invention include known polymers such as poly(styrene-butadiene), poly(methyl methacrylate-butadiene), poly(ethyl methacrylate-butadiene), poly(propyl methacrylate-butadiene), poly(butyl methacrylate-butadiene), poly (methyl acrylate-butadiene), poly(ethylacrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propylmethacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly (styrene-butylacrylate), poly(styrene-butadiene), poly (styrene-isoprene), poly(styrene-butyl methacrylate), poly (styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), poly(acrylonitrile-butyl acrylate-acrylic acid), and the like. The polymer resins formed from the above mentioned monomers are generally present in the toner composition in various effective amounts depending, for example, on the amount of the other components, and providing one or more of the objectives of the present invention are achievable. Polymers in the latex resin are generally present in the toner in various effective amounts, such as from about 35 weight percent to about 98 weight percent of the toner including all subranges and individual values with the range of from about 35 weight percent to about 98 weight percent, and the latex resin size suitable for the processes of the present invention can be, for example, of from about 0.05 microns to about 1.2 microns in volume average diameter as measured by a Brookhaven nanosize particle analyzer or Brookhaven disk centrifuge. Other sizes and effective amounts of latex polymer may be selected in certain embodiments.

Copolymer particles incorporated into the toners of the present invention are present in an amount of between about 1% to about 25% by weight of the toner regardless of whether the copolymer particles are bound to the colorant or primary toner particle or are dispersed within the primary toner particle. More particularly, copolymer particles incorporated into toners are present in an amount of between from about 4% to about 15%, and even more particularly from about 4% to about 10% by weight of the toner.

In general, usefull colorants or pigments include carbon black, magnetite, or mixtures thereof; cyan, yellow, magenta, or mixtures thereof; or red, green, blue, brown, or mixtures thereof. Typical usefull colorants or pigments are present in an effective amount of, for example, from about 1 to about 65 percent by weight, from about 1 to about 25 percent by weight and preferably from about 3 to about 10 percent by weight, Specific useful colorants include Paliogen Violet 5100 and 5890 (BASF), Normandy Magenta RD-2400 (Paul Uhich), Permanent Violet VT2645 (Paul Uhlich), Heliogen Green L8730 (BASF), Argyle Green XP-111-S (Paul Ulich), Brilliant Green Toner GR 0991 (Paul Uhlich), Lithol Scarlet D3700 (BASF), Toluidine Red (Aldrich), Scarlet for Thermoplast NSD Red (Aldrich), Lithol Rubine Toner (Paul Ulhlich), Lithol Scarlet 4440, NBD 3700 (BASF), Bon Red C Dominion Color), Royal Brilliant Red RD-8192 (Paul Uhlich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlich), Paliogen Yellow 152 and 1560 (BASF), Lithol Fast Yellow 0991K (BASF), Paliotol Yellow 1840 (BASF), Novaperm Yellow FGL (Hoechst), Permanerit Yellow YE 0305 (Paul Uhlich), Lumogen Yellow D0790 (BASF), Suco-Gelb L1250 (BASF), Suco-Yellow D1355 (BASF), Sico Fast Yellow D1165, D1355 and D1351 (BASF), Hostaperm Pink E (Hoechst), Fanal Pink D4830 (BASF), Cinquasia Magenta (DuPont), Paliogen Black L0084 (BASF), Pigment Black K801 (BASF) and carbon blacks such as REGAL 330 (Cabot), Carbon Black 5250 and 5750 (Columbian Chemicals), and the like or mixtures thereof Additional useful colorants include pigments in water based dispersions such as those commercially available from Sun Chemical, for example SUNSPERSE BHD 6011X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226) and the like or mixtures thereof Other useful water based colorant dispersions commercially available from Clariant include HOSTAFINE Yellow GR, HOSTAFINE Black T and Black TS, HOSTAFINE Blue B2G, HOSTAFINE Rubine F6B and magenta dry pigment such as Toner Magenta 6BVP2213 and Toner Magenta E02 which can be dispersed in water and/or surfactant prior to use.

Other useful colorants include magnetites, such as Mobay magnetites MO8029, MO8060; Columbian magnetites; MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100, or TMB-104; and the like or mixtures thereof. Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Examples of magentas include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like or mixtures thereof Illustrative examples of cyans include copper tetra(octadecyl sulfonamido) phthalocyanine, x-copper phthalocyanine pigment listed in the Color Index as CI74160, CI Pigment Blue, and Anthrathrene Blue, identified in the Color Index as CI 69810, Special Blue X-2137, and the like or mixtures thereof; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy4-sulfonanilide phenylazo4'-chloro-2,5-dimethoxy acetoacetanilide, and Permanent Yellow FGL. Colored magnetites, such as mixtures of MAPICO BLACK and cyan components may also be selected as pigments with the process of the present invention. Colorants include pigment, dye, mixtures of pigment and dye, mixtures of pigments, mixtures of dyes, and the like. It is to be understood that other useful colorants will become readily apparent to one of skill in the art based on the present disclosure.

Examples of the surfactant, which can be added to the aggregates before coalescence is initiated, can be anionic surfactants, such as sodium dodecylbenzene sulfonate, sodium dodecylnaphthalene sulfate, dialkyl benzenealkyl, sulfates and sulfonates, abitic acid, available from Aldrich, NEOGEN R, NEOGEN SC obtained from Kao, BIOSOFT D-40 obtained from Stepan, and the like or mixtures thereof. They can also be selected from nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylenenonylphenyl ether, dialkylphenoxypoly(ethyleneoxy) ethanol, available from Rhone-Poulenac as IGEPAI, CA-210, IGEPAL CA-520, IGEPAL CA-720, IGEPAL CO-890, IGEPAL CO-720, IGEPAI, CO-290, IGEPAL CA-210, ANTAROX 890, ANTAROX 897, and the like or mixtures thereof An effective amount of the anionic or nonionic surfactant utilized in the coalescence to primarily stabilize the aggregate size against further growth with temperature is, for example, from about 0.01 to about 10 percent by weight, and preferably from about 0.5 to about 5 percent by weight of the reaction. Additional methods of stabilizing aggregate size include raising pH of the emulsion above 6, such as through the addition of sodium hydroxide or potassium hydroxide.

Examples of flocculants or cationic surfactants include for example dialkyl benzenealkyl ammonium chloride, lauryl trimethyl amnonium chloride, alkylbenzyl methyl ammonium chloride, alkyl benzyl dimethyl ammonium bromide, benzalkonium chloride, cetyl pyridinium bromide, C-12, C-15, C-17 trimethyl ammonium bromides, halide salts of quaternized polyoxyethylaLkylamines, dodecylbenzyl triethyl ammonium chloride, MIRAPOL ALKAQUAT available from Alkaril Chemical Company, SANIZOL (benzalkonium chloride), available from Kao Chemicals, polyaluminum chloride (PAC) and polyaluminum sulfate silicate (PASS) and the like whether alone or in combination or mixture with other flocculants or cationic surfactants, in effective amounts of, for example, from about 0.01 percent to about 10 percent by weight. Preferably, the molar ratio of the cationic surfactant used for flocculation to the anionic surfactant used in the latex preparation is in the range of from about 0.5 to 4.

It is to be understood that other useful anionic and cationic surfactants will become readily apparent to one of skill in the art based on the present disclosure.

Examples of useful chain transfer agents include dodecanethiol, carbon tetrabromide and the like which can be used to control the molecular weight properties of the polymer when emulsion polymerization is carried out. It is to be understood that other useful chain transfer agents will become readily apparent to one of skill in the art based on the present disclosure. An effective concentration of a chain transfer agent that is generally employed is, for example, from about 0.005 to about 10 percent by weight, about 0.01 to about 5 percent by weight, and about 0.1 to about 3 percent by weight.

Examples of useful optional free radical initiators that can be selected for the preparation of the toners include azo-type initiators such as 2-2'-azobis(dimethyl-valeronitrile), azobis (isobutyronitrile), azobis(cyclohexane-nitrile), azobis (methyl-butyronitrile), mixtures thereof, and the like, peroxide initiators such as benzoyl peroxide, lauroyl peroxide, methyl ethyl ketone peroxide, isopropyl peroxy-carbonate, 2,5-dimethyl-2,5-bis(2-ethylhexanoyl-peroxy)hexane, di-tert-butyl peroxide, cumene hydroperoxide, dichlorobenzoyl peroxide, potassium persulfate, ammonium persulfate, sodium bisulfite, combination of potassium persulfate, sodium bisulfite and the like and mixtures thereof. It is to be understood that other useful free radical initiators will become readily apparent to one of skill in the art based on the present disclosure. An effective quantity of an initiator is within the range of about 0.1 percent to about 10 percent by weight of the reaction mixture.

The toner may also optionally include known charge additives in effective suitable amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like aluminum complexes, and the like.

Surface additives that can optionally be added to the toner compositions ater washing or drying include, for example, metal salts, metal salts of fatty acids, colloidal silicas, metal oxides like titanium oxides such as STT 100H commercially available from Carboxil, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Additional additives include zinc stearate in an amount of from about 0.1 percent to about 2% and silica such as AEROSIL R972.R, RX50, 709S, T6811S, TG810S, TG308S, S530 and TS720 available from Degussa in amounts of from about 0.1 to about 5 percent which can be added during the aggregation process or blended into the formed toner product.

The toner sized particles of the present invention are optionally surface halogenated, partially or wholly, for example 100 percent, to convert olefinic double bonds by an electrophilic addition reaction in the surface polymer chain backbone and pendant groups into the corresponding halogenated hydrocarbon functionality. In many instances, surface halogenation of toner particles affords further control of the variety of Theological properties that may be obtained from the copolymer resins. Surface halogenation is accomplished with a gaseous mixture or liquid solution of an effective amount of from 0.01 to about 5 double bond molar equivalents of halogen gas or halogen liquid dissolved in water, or an organic solvent, for example, chlorine gas, liquid bromine, or crystalline iodine dissolved in a solvent, such as an aliphatic alcohol, like ethanol which does not dissolve or substantially alter the size or shape of the toner particles.

When more reactive halogens such as fluorine are used, an inert carrier gas, such as argon or nitrogen, may be selected as a diluent, for example, from about 0.1 to about 98 percent by volume of the inert gas relative to the reactive halogen gas, to moderate the extent of reaction, and the temperature and control corrosivity of the halogenation-encapsulation process.

A number of equally useful halogenating agents are known that afford equivalent reaction products with olefinic double bonds as the aforementioned diatomic halogens, for example as disclosed by House in "Modem Synthetic Reactions", W.A. Benjamin, Inc., 2nd Ed., Chapter 8, page 422, and references cited therein, the disclosure of which is incorporated in its entirety by reference.

The aforementioned halogenation can be considered an addition reaction, that is, for example, the halogen reacts with, and diffuses into the toner resin, whereby a shell thereof is formed. The shell can be of various effective thicknesses; generally, however, the shell is of a thickness of from about 1 micron or less, and more specifically from about 0.1 to about 1 micron, in embodiments. Typical amounts of halogen consumed include, for example, from about 0.1 to about 1 gram of halogen per 100 grams of toner polymer resin.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Imaging methods are also envisioned with the toners of the present invention, reference for example a number of the patents mentioned herein, and U.S. Pat. Nos. 4,265,990; 4,585,884 and 4,563,408, the disclosures of which are totally incorporated herein by reference.

The following examples are set forth as representative of the present invention. These examples are not to be construed as limiting the scope of the invention as these and other equivalent embodiments will be apparent in view of the present disclosure, figures, tables, comparative examples and data and accompanying claims.

EXAMPLE I

Latex Synthesis Produced by Batch Emulsion Polymerization

A carboxylated latex designated as EA1-61 comprised of styrene/n-butyl acrylate/acrylic acid texpolymer of 82/18/2 composition using 1% ammonium persulfate initiator, was synthesized by a batch emulsion polymerization process in a 300G reactor, using Neogen R and Antarox 897 as surfactants using the latex preparation method described in Example II of U.S. Pat. No. 5,847,030 hereby incorporated by reference in its entirety. The final latex produced contained 40% solids of the polymer in 60% of water.

Preparation of Toner Particles Containing 4.3% LUCIDENE 246

250 g of the above latex was added to 400 g of deionized water along with 10 g of LUCIDENE 246 styrene/ethylhexylacrylate copolymer latex (MW wet sample 136,000) available from Morton Waterbased Polymers (containing 50% solids) and pigment dispersion (containing 7.6 g of BHD Sunsperse Cyan Pigment (53.4% ag.) available from Sun Chemicals, 2.3 g of cationic surfactant B-50 and 220 g of deionized water). The mixture was then transferred into a 2 liter jacketed kettle and the temperature was raised to 50° C. and held there for 2 hours to perform aggregation. The particle size measured on a Coulter Counter was 6.6 micron volume average diameter with GSD 1.16. 45 ml of Neogen R surfactant (20%) was added to stabilize the aggregates and the temperature was raised to 93° C. Coalescence was performed at this temperature for an additional 4 hours. The particle size measured upon completion was 7.3 micron volume average diameter with GSD 1.23 and the toner particles were designated as KLG-84. The particles were then washed several times with deionized water and dried in the freeze-dryer.

Preparation of Reference Cyan Toner Particles Without LUCIDENE 246

The latex designated as EA1-61 was aggregated and coalesced without the addition of LUCIDENE 246. Cyan toner designated EA1-61C with particle size of 6.9 micron and GSD 1.22 was produced. This toner was used as a reference in the following comparative fusing evaluation.

Comparative Fusing Evaluation

The above cyan toner particles (KLG-84) containing the styrene/ethylhexylacrylate copolymer along with the reference sample (EA1-61C) were evaluated by forming image on a Mita copier, and fusing the image on a roll fuser with a silicon coating to determine the image gloss and minimum fusing temperature. The data is presented in Table 1. The fusing properties of KLG-84 toner containing styrene/ethylhexylacrylate copolymer were significantly better, than fusing properties of corresponding EA1-61C toner prepared from the same latex but without styrene/ethylhexylacrylate copolymer. Toner KLG-84 gave a crease 60 fixed temperature of 186° C. on ILX paper, which is 15 ° C. lower than crease of the comparable sample EA1-61C4 (201° C.), crease 30 fix temp of 210°, which is 18° C. lower than corresponding fix temp for KLG-84 (228° C.). Gloss $T_{40}$ temperature was slightly lower for EA1-61C4 (189° C. compared to 182° C.), Gloss $T_{50}$ temperature was slightly lower for EA1-61C4 (198° C. compared to 192° C), cold offset temperature (COT) was equal to 145° C. compared to 150° C. for reference sample and hot offset temperature (HOT) temperatures were identical, which gives toner containing the copolymers wider fusing latitude compared with the toner which did not include the copolymers.

EXAMPLE II

Oxygen Free Latex Produced by Batch Emulsion Polymerization

A carboxylated latex designated as EAl-100 comprised of a styrene/n-butyl, acrylate/acrylic acid terpolymer of 82/18/2 composition, using 1% ammonium persulfate initiator, was synthesized by batch emulsion polymerization process in a 300G reactor, using Neogen R and Antarox 897 as surfactants, with the rigorous exclusion of oxygen to produce an "oxygen free" latex. The final latex contained 40% polymeric resin solids dispersed in 60% water and/or surfactant. The latex can be used in aggregation processes to prepare pigmented toner particles.

Preparation of Toner Particles Containing 4.3% LUCIDENE 246

250 g of the above "oxygen free" latex was added to 400 g of deionized water along with 10g of LUCIDENE 246 styrene/ethylhexylacrylate copolymer latex (MW wet sample 136,000) available from Morton Waterbased Polymers (containing 50% solids) and pigment dispersion (containing 7.6 g of BHD Sunsperse Cyan Pigment (53.4% aq.), 2.3 g of cationic surfactant B-50 and 220 g of deionized water), while being polytroned. Polytroning was continued for additional 2 min at 10,000 RPM. The dispersion was then transferred into a 2 liter jacketed kettle and the temperature was raised to 50° C. and held there for 1.5 hours to perform aggregation. The particle size measured was 7.4 micron with GSD 1.19. 40 ml of Neogen R surfactant (20%) was added to stabilize the aggregates and the temperature was raised to 93° C. Coalescence was performed at this temperature for an additional three hours. The particle size measured upon completion was 8.3 micron with GSD 1.22. The toner produced was identified as KLG-99. The particles were then washed several times with deionized water and dried on the freeze dryer.

Preparation of Toner Particles Containing 8.6% LUCIDENE 246

240 g of the above "oxygen free" latex was added to 400 g of deionized water along with 20 g of LUCIDENE 246 styrene/ethylhexylacrylate copolymer latex (MW wet sample 136,000) available from Morton Waterbased Polymers (containing 50% solids) and pigment dispersion (containing 7.6 g of BHD Sunsperse Cyan Pigment (53.4% aq.), 3.0 g of cationic surfactant B-50 and 220 g of deionized water), while being polytroned. Polytroning was continued for an additional two minutes at 10,000 RPM. The dispersion was then transferred into a 2 liter jacketed kettle and the temperature was raised to 50° C. and held there for 1.5 hours to perform aggregation. The articles size measured was 7.2 micron with GSD 1.22. 40 ml of Neogen R surfactant (20%) was added to stabilize the aggregates and the temperature was raised to 93° C. Coalescence was performed at this temperature for as additional three hours. The particle size measured upon completion was 8.3 micron with GSD 1.24. The toner produced was identified as KLG-100. The particles were then washed several times with deionized water and dried on the freeze dryer.

Preparation of Toner Particles Containing 8.6% LUCIDENE 246

240 g of the above "oxygen free" was added to 400 g of deionized water along with 20 g of LUCIDENE 246 available from Morton Waterbased Polymers (containing 50% solids) and pigment dispersion (containing 7.6 g of BHD Sunsperse Cyan Pigment (53.4% aq.), 3.0 g of cationic surfactant B-50 and 220 g of deionized water), while being polytroned. Polytroning was continued for an additional two minutes at 10,000 RPM. The dispersion was then transferred into a 2 liter jacketed kettle and the temperature was raised to 50° C. and held there for two hours to perform aggregation. The particle size measured was 7.1 micron with GSD 1.22. 47 ml of Neogen R surfactant (20%) was added to stabilized the aggregates and the temperature was raised to 93° C. Coalescence was performed at this temperature for an additional three hours. The particle size measured upon completion was 8.2 micron with GSD 1.19. The toner produced was identified as KLG-101. The particles were then washed several times with deionized water and dried on the freeze dryer.

Preparation of Toner Particles Containing 8.6% LUCIDENE 246

245 g of the above "oxygen free" latex was added to 400 g of deionized water along with 15 g of LUCIDENE 246 styrene/ethylhexylacrylate copolymer latex (MW wet sample 136,000) available from Morton Waterbased Polymers (containing 50% solids) and pigment dispersion (containing 7.6 g of BHD Sunsperse Cyan Pigment (53.4% aq.), 3.0 g of catioric surfactant B-50 and 220 g of deionized water), while being polytroned. Polytroning was continued for an additional two minutes at 10,000 RPM. The dispersion was then transferred into a 2 liter jacketed kettle and the temperature was raised to 48° C. and held there for 1.5 hours to perform aggregation. The particle size measured was 6.3 micron with GSD 1.20. 47 ml of Neogen R surfactant (20%) was added to stabilized the aggregates and the temperature was raised to 93° C. Coalescence was performed at this temperature for an additional three hours. The particle size measured upon completion was 7.1 micron with GSD 1.20. The toner produced was identified as KLG-103. The particles were then washed several times with deionized water and dried on the freeze dryer.

Preparation of Reference Cyan Toner Particles Without LUCIDENE 246

The latex designated EA1-100 was aggregated and coalesced without the addition of LUCIDENE 246. Cyan toner identified as EA1-100C with particle size of 7.1 micron and GSD 1.20 was produced. This toner was used as a reference in a comparative fusing example the results of which are presented in Table 1.

EXAMPLE III

Latex Synthesis Produced by Semicontinuous Emulsion Polymerization

A carboxylated latex designated as CMC-55-45 comprised of styrene/n-butyl acrylate/acrylic acid teipolymer of 75/25/3 composition using 1.5% ammonium persulfate initiator, was synthesized by a semicontinuous emulsion polymerization process in a 2 liter jacketed glass flask with a stirrer set at 200 rpm, and containing 12.7 grams of Dowfax 2A1 (sodium tetrapropyl diphenyloxide disulfonate, 47 percent active, available from Dow Chemical), 6.0 grams of polyoxyethylene nonyl phenyl ether nonionic surfactant, ANTAROX CA 897 (70 percent active), and 519 grams of deionized water. The contents were purged with nitrogen for 30 minutes while the temperature was from about 25° C. to 80° C. A monomer emulsion was prepared by homogenizing a monomer mixture (405 grams of styrene, 135 grams of n-butyl acrylate, 16.2 grams of acrylic acid, and 5.4 grams of 1-dodecanethiol) with an aqueous solution (6.4 grams of Dowfax 2A1, 3.0 grams of ANTAROX CA-897, and 251 grams of deionized water) at 10,000 rpm for 5 minutes at room temperature of about 25° C. via VirTishear Cyclone Homogenizer. Forty one (41) grams of seed was removed from the monomer emulsion and added into the flask, and the flask contents were stirred for 5 minutes at 80° C. An initiator solution prepared from 8.1 grams of ammonium persulfate in 40 grams of deionized water was added to the flask mixture over 20 minutes. Stirring continued for an additional 20 minutes to allow a seed particle formation. The remaining 782 grams of monomer emulsion were fed continuously into the reactor over 4 hours and 40 minutes. The nitrogen purge was reduced to a slow trickle to maintain a small positive pressure. After the above monomer emulsion addition was completed, the reaction was allowed to post react for 120 minutes at 80° C. No strong exotherm was observed throughout the reaction when the above in situ seeded, monomer emulsion fed process was implemented. Only a very mild exotherm of about 0.3° C. was observed during the initial seed formation stage. The resulting latex polymer possessed an $M_w$ of 36,000, $M_n$ of 12,100, as determined on a Waters GPC, and a mid-point Tg of 58.1° C., as measured on a Seiko DSC. The resulting resin contained 41% solids. The latex resin possessed an volume average diameter of 202 nanometers as measured by light scattering technique on a Coulter N4 Plus Particle Sizer.

Preparation of Toner Particles Containing 8.6% LUCIDENE 246

20 g of LUCIDENE 246 styrene/ethylhexylacrylate copolymer latex (MW wet sample 136,000) available form Morton Waterbased Polymers (containing 50% solids) was initially dispersed in 400 g of deionized water using a homogenizer (polytron). To this dispersion, 240 g of the above latex (CMD-55-45) was added to along with pigment dispersion (containing 7.6 g of BHD Sunsperse Cyan Pigment (53.4% aq.), 4.3 g of cationic surfactant B-50 and 220 g of deionized water), while being polytroned. Polytroning was continued for additional two minutes at 10,000 RPM. The dispersion was then transferred into a 2 liter jacketed kettle and the temperature was raised to 50° C. and held there for two hours to perform aggregation. The particle size measured was 6.2 micron with GSD 1.18. 31 ml of Neogen R surfactant (20%) was added to stabilized the aggregates and the temperature was raised to 93° C. Coalescence was performed at this temperature for an additional three hours. The particle size measured upon completion was 6.7 micron with GSD 1.19. The toner produced was identified as KLG-102. The particles were then washed several times with deionized water and dried on the freeze dryer.

Preparation of Reference Cyan Toner Particles Without LUCIDENE 246

The latex designated as CMC-45-55 was aggregated and coalesced without the addition of LUCIDENE 246. The resulting Cyan toner was identified as KLG-97 with particle size of 6.3 micron and GSD 1.22 was produced. This toner was used as a reference in the following comparative fusing evaluation.

Comparative Fusing Evaluation

The above cyan toner particles (KLG-102) containing styrene/ethylhexylacrylate copolymer along with the reference sample (KLG-97) were evaluated by forming images on a Mita copier and the images on a roll fuser with a silicon coating to determine the image gloss and minimum fusing temperature. The fusing properties of KLG-102 toner containing styrene/ethylhexylacrylate copolymer were significantly better than fusing properties of corresponding KLG-97 toner without styrene/ethylhexylacrylate copolymer. Toner KLG-102 gave a crease 60 fix temperature of 180° C. on ILX paper, which is 15° C. lower than the crease of the comparable sample KLG-97, and a crease 30 fix temperature of 198° C., which is 22° C. lower than the corresponding fix temperature for KLG-97 (220° C.). The Gloss $T_{40}$ temperature for the reference was slightly lower (193° C. compared to 188° C.), the Gloss $T_{50}$ temperature for the reference was slightly lower (202° C. compared to 198° C.), COT for KLG-102 was equal to 140° C. compared to 145° C. for the reference sample, and HOT temperatures were identical, which gives the toner with the copolymers wider fusing latitude compared with the toner without the copolymers.

The results of the above examples are presented in Table 1 below.

TABLE 1

Toner Particles - Particle Characteristics and Fusing Properties

| Sample ID | Particle Shape | Mw/Mn K | Tg,mid ° C. | Size, μm (GSD) | Crease C60 ° C. | Crease C30 ° C. | COT ° C. | HOT ° C. | Gloss $TG_{50}$ ° C. | Peak Gloss Gmax |
|---|---|---|---|---|---|---|---|---|---|---|
| KLG-84 (latex EA1-61 + 4.3% Lucidene 246) | Potato | 32/4.5 | 57.2 | 7.3 (1.23) | 186 | 210 | 145 | >210 | 198 | 64 |
| Reference EA1-61C4 (latex EA1-61) | Potato | 29/5.8 | 55.2 | 6.9 (1.19) | 201 | 228 | 150 | >210 | 192 | 67 |
| KLG-103 (latex EA1-61 + 6.5% Lucidene 246) | Potato | 37/4.2 | 53.4 | 7.2 (1.20) | 166 | 180 | 135 | >210 | 205 | 55 |
| Reference EA1-100C (latex EA1-100C) | Potato | 34/4.3 | 53.0 | 7.1 (1.20) | 198 | 231 | 140 | >210 | 194 | 64 |
| KLG-102 (latex CMC-55-45 + 8.6% Lucidene 246) | Potato | 44/8.4 | 55.5 | 6.7 (1.19) | 180 | 198 | 140 | >210 | 202 | 60 |
| Reference KLG-97 (latex cmc55-45) | Potato | 35/7.5 | 54.8 | 6.3 (1.22) | 195 | 220 | 145 | >210 | 198 | 64 |

EXAMPLE IV

Combining Copolymers with Pigment Particles

Two processes were developed for the combination of copolymers with pigment particles. According to process #1, 7.6 g of a water based dispersion of pigment commercially available from Sun Chemical (cyan 15.3 BHD 6000 dispersion in water—53% solids) was mixed with 15 g of LUCIDENE 246 styrene/ethylhexylacrylate copolymer (Mw=136K, 50% solids commercially available from Morton Waterbased Polymers) by roll-milling overnight at room temperature. The affinity between the styrene/ethylhexylacrylate copolymer particles and the pigment produced pigment particle; having a styrene/ethylhexylacylate copolymer coating. This blend was than diluted with 200 g of deionized water and roll-milled for additional ½ hour. Pigment dispersion prepared this way was then added to 400 g of deionized water and polytroned at 10000 RPM simultaneously with 240 g of latex CMC-31-74 (described below), and 2.3 g of Sanizol B-50 (50% solids) coagulant. Polytroning was continued for 2 minutes. The dispersion was then transferred into a 2L jacketed kettle and the temperature was raised to 49° C. and held there for 1.5 hours to perform the aggregation. The particle size measured was 6.4 μm with GSD=1.21. 30 ml of anionic surfactant Biosoft D40 (20% aq.) was than added to the aggregates. The coalescence of the aggregated particles was performed by raising the temperature to 93 ° C. and held there for a period of 3 hours. The particle size measured upon completion was 6.6 um with GSD=1.23. (Sample KLG-187). Coalesced particles were then washed at pH=8.5 with NaOH, to remove residual surfactants and rinsed with water to remove NaOH and dried. Resulting particles contained ~90% latex resin, 3.5% pigment blue 15.3 and 6.5% of copolymer.

According to process #2, 15 g of LUCIDENE 246 styrene/ethylhexylacrylate copolymer (Mw=136K, 50% solids commercially available from Morton Waterbased Polymers) was dispersed in 400 g of deionized water while polytroning at 10000 RPM. This copolymer dispersion was mixed with 7.6 g of a water based dispersion of pigment commercially available from Sun Chemical (cyan 15.3 BHD 6000 dispersion in water—53% solids) commercially available from Sun Chemical and 200 g of deionized water. To this copolymer/pigment mixture, 240 g of latex CMC-31-74 (described below) and 2.3 g of Sanizol B-50 (50% solids) coagulant were added as well. Polytroning was continued for 2 minutes. The dispersion was than transferred into a 2L jacketed kettle and the temperature was raised to 49° C. and held there for 1.5 hours to perform the aggregation. The particle size measured was 7.0 μm with GSD=1.21. 30 ml of anionic surfactant Biosoft D40 (20% aq.) was than added to the aggregates. The coalescence of the aggregated particles was performed by raising the temperature to 93° C. and held there for period of 3 hours. The particle size measured upon completion was 7.1 μm with GSD=1.21. (Sample KLG-189). Coalesced particles were then washed at pH=8.5 with NaOH, to remove residual surfactants and rinsed with water to remove NaOH and dried. Resulting particles contained ~90% latex resin, 3.5% pigment blue 15.3 and 6.5% of copolymer.

Toner Samples Combining Copolymers with Pigment Particles

The following toner samples were prepared which included copolymers combined to pigment particles. Latex CMC-31-74 was prepared in the manner described above for Latex EA 1-100-C as follows: A latex was prepared by the semicontinuous emulsion polymerization of styrenet/butyl acrylate/2-carboxyethyl acrylate, 75/25/6 parts (by weight), as follows. A 2 gallon jacketed glass flask with a stirrer set at 120 rpm, and containing 35.5 grams of Dowfax 2A1 (sodium tetrapropyl diphenyloxide disulfonate, 47 percent active, available from Dow Chemical), 12 grams of polyoxyethylene nonyl phenyl ether nonionic surfactant, ANTAROX CA 897 (70 percent active), and 2076 grams of deionized water was purged with nitrogen for 30 minutes while the temperature was from about 25° C. to 80° C. A monomer emulsion was prepared by homogenizing a monomer mixture (1620 grams of styrene, 540 grams of n-butyl acrylate, 129.6 grams of 2-carboxyethyl acrylate, and 28.4 grams of 1-dodecanethiol) with an aqueous solution (17.8 grams of Dowfax 2A1, 6 grams of ANTAROX CA-897, and 1004 grams of deionized water) at 10,000 rpm for 15 minutes at room temperature of about 25° C. via VirTishear Cyclone Homogenizer. Forty one (164) grams of seed was removed from the monomer emulsion and added into the flask, and the flask contents were stirred for 5 minutes at 80° C. An initiator solution prepared from 32.4 grams of ammonium persulfate in 160 grams of deionized water was added to the flask mixture over 20 minutes. Stirring continued for an additional 20 minutes to allow a seed particle formation. The remaining 3192 grams of monomer emulsion were fed continuously into the reactor over 4 hours. The nitrogen purge was reduced to a slow trickle to maintain a small positive pressure. After the above monomer emulsion addition was completed, the reaction was allowed to post react for 120 minutes at 80° C. No strong exotherm was observed throughout the reaction when the above in situ seeded, monomer emulsion fed process was implemented. Only a very mild exotherm of about 0.5° C. was observed during the initial seed formation stage. The resulting latex polymer possessed an $M_w$ of 30,000, an $M_n$ of 8,900, as determined on a Waters GPC, and a mid-point Tg of 52.2° C., as measured on a Seiko DSC. The resulting resin contains 42 percent solids. The latex resin possessed an volume average diameter of 162 nanometers as measured by light scattering technique on a Coulter N4 Plus Particle Sizer.

TABLE 2

| Sample | Latex | Process | % LUCIDENE Added | Total % |
|---|---|---|---|---|
| KLG-186 | CMC-31-74 | #1 | 6.5% | 13.0% |
| | | #2 | 6.5% | |
| KLG-188 | CMC-31-74 | #2 | 13.0% | 13.0% |
| KLG-187 | CMC-31-74 | #1 | 6.5% | 6.5% |
| KLG-189 | CMC-31-74 | #2 | 6.5% | 6.5% |
| KLG-103 | EA1-100C | #2 | 6.5% | 6.5% |

EXAMPLE V

Formulation and Synthesis of Latex with Encapsulated Copolymers

A latex was prepared which included copolymer uniformly distributed within primary toner particles and was designated CMC 27955-102. The latex particles may be characterized as having the copolymer in the core of the latex particles and a styrene/n-butyl acrylate/acrylic acid terpolymer shell. The latex particles were synthesized by a seeded, semi-continuous emulsion polymerization process. LUCIDENE 246 styrene/ethylhexylacrylate copolymer latex (MW wet sample 136,000) available from Morton Waterbased Polymers (containing 50% solids) was used as seed emulsion. In a 2 liter jacketed glass reactor with a stirrer set at 200 rpm, 57 grams of LUCIDENE 246 emulsion, 8.8 grams of Dowfax 2A1 (sodium tetrapropyl diphenyloxide disulfonate, 47% active, Dow Chemical), 3.0 grams of Antarox CA-897 (70% active, octylphenol aromatic ethoxylate, Rhone-Poulenc), and 501 grams of deionized water were deaerated for 30 min while the temperature was raised to 80° C. A monomer emulsion was prepared by homogenizing a monomer mixture (364 grams of styrene, 149 grams of n-butyl acrylate, 15.4 grams of acrylic acid, and 5.1 grams of 1 -dodecanethiol) with an aqueous solution (4.4 grams of Dowfax 2A1, 1.5 grams of Antarox CA-897, 8.1 grams of ammonium persulfate, and 279) grams of deionized water) at 10,000 rpm for 5 min at room temperature. The monomer emulsion was fed into the reactor over 280 min. At the conclusion of the monomer feed, the emulsion was post-heated at 80° C. for 90 min, then cooled. The reaction system was deoxygenated by passing a stream of nitrogen through it throughout the reaction. No strong exotherm was observed throughout the reaction when this in-situ seeded, monomer emulsion fed process was implemented. A latex containing 42 percent solids with an average particle size of 292 nm was obtained. This latex has a Mw of 40,000 and a Tg of 51.1° C.

Aggregation/Coalescence 260 grams of the above latex was simultaneously added, with a pigment solution containing 7.6 grams of BHD 6000 Sunsperse Cyan Pigment (53.4% aq.), 2.3 grams of Sanizol B, and 220 grams of deionized water to 400 grams of deionized water while being polytroned at 10000RPM. The dispersion was then transferred into a 2L jacketed kettle and the temperature was raised to 49° C. and held there for 1.5 hours to perform the aggregation. The particle size measured was 6.3 $\mu$m with a GSD of 1.21. 30 ml of anionic surfactant Biosoft D40 (20% aq.) was then added to the aggregates. The coalescence step was performed by raising the temperature to 93° C. and held there for a period of 3 hours. The particle size measured upon completion was 6.6 $\mu$m with a GSD of 1.22 (Sample KLG-183). Coalesced particles were then washed at pH=8.5 to remove residual surfactants and rinsed with water, to remove KOH.

Preparation of Reference Cyan Toner Particles Without LUCIDENE 246

Reference sample KLG-102 which is a Cyan toner including LUCIDENE 246 but prepared by a nonseeding method was used as a reference in the following comparative fusing evaluation.

Comparative Fusing Evaluation

The above cyan toner particles (KLG-183) were evaluated by forming image in a Mita copier, and fusing the image using a roll fuser with a silicon coating to determine the image gloss and minimum fusing temperature. This toner gave crease 60 fix of 161° C., (compare with 170° C. for KLG-102) and acrease 30 of 173° C. (vs 184° C. for KLG-102) on ILX paper, COT was 10° C. lower (130° C. vs 140° C. for KLG-102). The blocking and HOT temperatures were comparable. For this toner the $G_{40}$ gloss temperature was 196° C. (vs 193° C. for KLG-102). The above data demonstrates that the toner with the copolymers exhibits wider fusing latitude compared with the toner without the copolymers.

It is to be understood that the embodiments of the present invention which have been described are merely illustrative of some of the applications of the principles of the invention. Numerous modifications may be made by those skilled in the art based upon the teachings presented herein without departing from the true spirit and scope of the invention.

What is claimed is:

1. A process for the preparation of toner comprising:

(i) polymerizing an aqueous latex emulsion comprising one or more monomers, an optional nonionic surfactant, an optional anionic surfactant, an optional free radical initiator, an optional chain transfer agent and one or more copolymers to form emulsion resin particles having the one or more copolymers dispersed therein;

(ii) combining the emulsion resin particles with colorant to form statically bound aggregated composite particles;

(iii) heating the statically bound aggregated composite particles to form toner; and (iv) optionally isolating the toner.

2. The process of claim 1 wherein the one or more copolymers having a particle size of between about 0.05 and about 1.2 microns volume average diameter.

3. The process of claim 1 wherein the copolymer comprises a styrene functional monomer and an acrylate selected from the group consisting of alkyl acrylates, alkyl methacrylates, aromatic (meth)acrylates and alkyl (meth) acrylates.

4. The process of claim 3 wherein the styrene functional monomer is selected from the group consisting of styrene, methylstyrene, 4-methylstyrene, 3-chlorostyrene, 2,5-dichlorostyrene, 4-bromostyrene, 4-tert-butylstyrene, 4-methoxystyrene.

5. The process of claim 3 wherein the alkyl acrylate comprises acrylic ester having an alkyl group of from about four to about twelve carbon atoms.

6. The process of claim 5 wherein the alkyl acrylate is selected from the group consisting of butyl acrylate, hexyl acrylate, heptyl acrylate, 2-ethylhexyl acrylate, octyl acrylate, decyl acrylate, and lauryl acrylate.

7. The process of claim 3 wherein the alkyl methacrylate is methacrylic ester having an alkyl group of from about six to about eighteen carbon atoms.

8. The process of claim 7 wherein the alkyl methacrylate is selected from the group consisting of hexyl methacrylate, heptyl methacrylate, 2-ethylhexyl methacrylate, octyl methacrylate, decyl methacrylate, lauryl methacrylate, and stearyl methacrylate.

9. The process of claim 3 wherein the aromatic (meth) acrylate is selected from the group consisting of benzyl acrylate, phenyl acrylate, phenethyl acrylate, benzyl methacrylate, and phenyl methacrylate.

10. The process of claim 1 wherein the monomers are selected from the group consisting of acrylates, acrylic acids, methacrylates, methacrylic acids, acrylonitrile, styrene, styrene derivatives of methyl acrylate, ethylacrylate, propyl acrylate, butyl acrylate, hexyl acrylate, methyl methacrylate, ethyl methacrylate, propyl methacrylate, butyl methacrylate, hexyl methacrylate, methyl styrene, alkyl substituted styrenes, halogenated styrenes, halogenated alkyl substituted styrenes, butadiene, substituted butadienes, methyl butadiene, isoprene, mycerine, and alkyl substituted isoprene.

11. The process of claim 1 wherein the emulsion resin particles are selected from the group consisting of poly (styrene-alkyl acrylate), poly(styrene-1,3-diene), poly (styrene-alkyl methacrylate), poly(styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid, poly(styrenebutadiere), poly(methylstyrene-butadiene), poly(methylmethacrylate-butadiene), poly(ethyl methacrylate-butadiene), poly(propyl methacrylate-butadiene), poly(butylmethacrylate-butadiene), poly(methyl acrylate-butadiene), poly(ethyl acrylate-butadiene), poly (propyl acrylate-butadiene), poly(butyl acrylate-butadiene), poly(styrene-isoprene), poly(methylstyrene-isoprene), poly (methyl methacrylate-isoprene), poly(ethyl methacrylate-isoprene), poly(propyl methacrylate-isoprene), poly(butyl methacrylate-isoprene), poly(methylacrylate-isoprene), poly (ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly (styrene-butadiene-acrylonitrile-acrylic acid), poly(styrene-butylacrylate-acrylic acid), poly(styrene-butyl acrylate-methacrylic acid), poly(styrene-butyl acrylate-acrylononitrile), and poly(styrene-butyl acrylate-acrylononitrile-acrylic acid).

12. A process of claim 1 wherein the nonionic surfactant is selected from the group consisting of polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylenenonylphenyl ether, and dialkylphenoxypoly(ethyleneoxy) ethanol.

13. The process of claim 1 wherein the anionic surfactant is selected from the group consisting of sodium dodecylsulfate, sodium dodecylbenzenesulfate, sodium dodecylnaphthalenesulfate, sodium dodecylbenzene sulfonate, dialkyl benzenealkyl, sulfates and sulfonates, and abitic acid.

14. The process of claim 1 wherein the cationic surfactant is a selected from. the group consisting of dialkyl benzene-alkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, C-12, C-15, C-17 trimethyl ammonium bromides, halide salts of quaternized polyoxyethylalkylamines, dodecylbenzyl triethyl ammonium chloride, and benzalkonium chloride.

15. The process of claim 1 wherein the pigment is carbon black, magnetite, or mixtures thereof; cyan, yellow, magenta, or mixtures thereof; or red, green, blue, brown, or mixtures thereof.

16. A process for the preparation of toner comprising:

(i) polymerizing an aqueous latex emulsion comprising one or more monomers, an optional nonionic surfactant, an optional anionic surfactant, an optional free radical initiator, and an optional chain transfer agent to form emulsion resin particles;

(ii) combining the emulsion resin particles with one or more copolymers to form aggregated primary toner particles;

(iii) combining the aggregate primary toner particles with colorant to form statically bound aggregate composite particles, (iv) heating the statically bound aggregated composite particles to form toner; and (v) optionally isolating the toner.

17. A process for the preparation of toner particles comprising:

(i) contacting colorant with one or more copolymers to produce colorant particles combined with the one or more copolymers;

(ii) polymerizing an aqueous latex emulsion comprising one or more monomers, an optional nonionic surfactant, an optional anionic surfactant, an optional free radical initiator, and an optional chain transfer agent to form emulsion resin particles to form emulsion resin particles;

(iii) combining the emulsion resin particles with the colorant combined with the one or more copolymers to form statically bound aggregated composite particles;

(iv) heating the statically bound aggregated composite particles to form toner; and (v) optionally isolating the toner.

18. Toner comprising colorant combined with one or more copolymers and resin particles.

19. Toner comprising colorant and resin particles having one or more copolymers bound thereto.

20. Toner comprising colorant and resin particles having one or more copolymers dispersed therein.

* * * * *